US010633209B2

(12) United States Patent
Caye

(10) Patent No.: US 10,633,209 B2
(45) Date of Patent: Apr. 28, 2020

(54) APPLICATION DEVICE FOR LOW COST COVERING ON SIR WIRE, TETHER WIRES, AND ANY ROUND ROD SHAPED COMPONENT

(71) Applicant: Ford Global Technologies, LLC, Dearborn, MI (US)

(72) Inventor: Mark Caye, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 291 days.

(21) Appl. No.: 15/419,597

(22) Filed: Jan. 30, 2017

(65) Prior Publication Data

US 2018/0215570 A1 Aug. 2, 2018

(51) Int. Cl.
*B65H 35/00* (2006.01)

(52) U.S. Cl.
CPC ..... *B65H 35/0033* (2013.01); *B65H 2402/33* (2013.01); *B65H 2402/344* (2013.01); *B65H 2402/412* (2013.01); *B65H 2402/541* (2013.01); *B65H 2403/47* (2013.01); *B65H 2701/1944* (2013.01)

(58) Field of Classification Search
CPC .. B65H 37/002; B65H 37/02; B65H 35/0026; B65H 35/002; B65H 35/0033; B65H 2702/20; B65H 2402/344; B65H 2402/33; B65H 2402/541; B65H 2403/47
See application file for complete search history.

(56) References Cited

U.S. PATENT DOCUMENTS 6,098,690 A * 8/2000 Robichaud ..... B65H 35/0026 156/577
2011/0017392 A1* 1/2011 Erives ..... H01B 13/01281 156/250
2011/0057010 A1 3/2011 Jonker

FOREIGN PATENT DOCUMENTS

DE 102007047575 A1 4/2009
DE 102013019696 A1 * 5/2015 ..... B65H 19/29
KR 101287157 B1 7/2013

OTHER PUBLICATIONS

Standke, "DE 10 2013 019 696, machine translation", Published May 28, 2015.*

* cited by examiner

*Primary Examiner* — Alex B Efta
(74) *Attorney, Agent, or Firm* — David Coppiellie; Brooks Kushman, P.C.

(57) ABSTRACT

A tape dispenser is disclosed. The tape dispenser may include a pair of spools that are configured to carry tape and a spring disposed between the spools. The spring is preferably arranged to form a claw having two distal ends biased towards each other. The distal ends may each include a roller rotatably attached thereto. The spring may be configured to open responsive to a force on the roller resulting from a shaft coming between the rollers such that the rollers rotate to travel around the shaft to apply the tape.

10 Claims, 5 Drawing Sheets

APPLICATION DEVICE FOR LOW COST COVERING ON SIR WIRE, TETHER WIRES, AND ANY ROUND ROD SHAPED COMPONENT

TECHNICAL FIELD

This disclosure relates to masking, concealing, or painting rounded components of a vehicle seat structure.

BACKGROUND

Automotive vehicle seat structures often include elongated rounded metal parts disposed underneath the foam and trim of a vehicle seat or external to the seat structure. Supplemental inflation restraint (SIR) members, lower anchors and tethers for children (LATCH) restraint systems, and lumbar support systems generally include various rounded spring wire or metal round stock. Generally, the metal portion of the seat structure is painted or coated with a rust prohibitive coating. It is advantageous to mask or conceal certain components after they have been assembled to the seat structure to prevent unwanted contaminants, e.g. paint, coating, or weld splatter from coming into contact with a specified rounded surface.

SUMMARY

According to one embodiment of this disclosure, a tape dispenser is disclosed. The tape dispenser may include a pair of spools that are configured to carry tape and a spring disposed between the spools. The spring is preferably arranged to form a claw having two distal ends biased towards each other. The distal ends may each include a roller rotatably attached thereto. The spring may be configured to open responsive to a force on the roller resulting from a shaft coming between the roller such that the rollers rotate to travel around the shaft to apply the tape.

According to another embodiment of this disclosure, a tape dispenser is disclosed. The tape dispenser preferably includes a body, a supply spool and a retracting spool disposed on the body. A claw is preferably formed by first and second arms that are each pivotally attached to the body between the spools. Preferably each of the arms include a roller that is pivotally attached thereto and configured to open responsive to a force on the rollers resulting from a shaft coming between the rollers such that the rollers rotate to travel around the shaft to apply the tape.

According to yet another embodiment of this disclosure, a tape applicator device is disclosed. The device preferably includes a supply pulley and a retracting pulley each attached to a planar body. The device may include a claw formed by first and second applicator arms each pivotally attached to a portion of the body that is disposed between the supply pulley and the retracting pulley and at least two rollers that are pivotally attached to a distal end of the first and second applicator arms. During operation, as the device moves toward a rounded surface, the rollers preferably move about the rounded surface and the supply pulley may be rotated to provide a piece perforated piece of tape. As the device is removed from the rounded surface, the retracting roller retracts the roll of tape such that a new piece of perforated tape is positioned across the rollers.

The devices as generally described above may each additionally be described by the following.

The pair of spools may include a supply spool and a retracting spool. During operation, a portion of a roll of tape may be fed from the supply spool.

The tape dispenser may further include a base, a spring and a pawl. Spring and the whole are preferably offered weakened coupled between the retracting spool and the body. The retracting spool may define an internal gear portion. Preferably, the spring, pawl and internal gear portion facilitates a ratcheting movement of the retracting spool.

The retracting roller may have an outer diameter that corresponds to a length of a piece of perforated tape so that as the tape is applied to a rounded surface, the retracting roller rotates and retracts the roll of tape so that an unapplied piece of tape is positioned across the two applicator rollers.

Each of the rollers may have an outer diameter wherein the outer diameter corresponds to a diameter of the shaft such that the piece tape covers a predetermined portion of the shaft.

The tape dispenser may also include a handle attached to the body and configured to allow a user to grasp the tape dispenser.

The roll of tape preferably includes a perforated tape section and a backing. The roll of tape is preferably stretched across the rollers between the supply spool and the retracting spool.

The body is preferably U-shaped having a top portion and bottom portion defining a space therebetween. The supply spool and the retracting spool may be disposed within the space.

The first and second arms preferably have a distal end and each include a top member and a bottom member wherein the rollers are disposed within the top member and bottom member of each arm.

BRIEF DESCRIPTION OF THE DRAWINGS

FIG. 2-A is a progressive-view of the applicator device in operation.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Vehicle seat structures often include elongated and rounded metal parts disposed underneath the foam and trim of the seat structure and for attaching various components to the parts may be external to the seat structure. Supplemental inflation restraint (SIR) members, the lower anchors and tethers for children (LATCH) restraint systems, and lumbar support systems generally include various rounded spring wire or metal round stock. Generally, the metal portion of the seat structure is painted or coated with a rust prohibitive mat. It is advantageous to mask or conceal certain components after they have been assembled to the seat structure but before the seat structure enters the paint process.

Concealing components so that they are not painted may be accomplished by applying a tape or other material with an adhesive backing. Applying tape to these components is often time and labor intensive. Moreover, consistent application of the tape in terms of quantity and location of the tape is dependent on the operator and difficult to control. Another challenge is applying the tape to a majority of the rounded surface, as opposed to only the side visible to the operator. The following disclosure aims at resolving the problems mentioned above.

Figure 1:
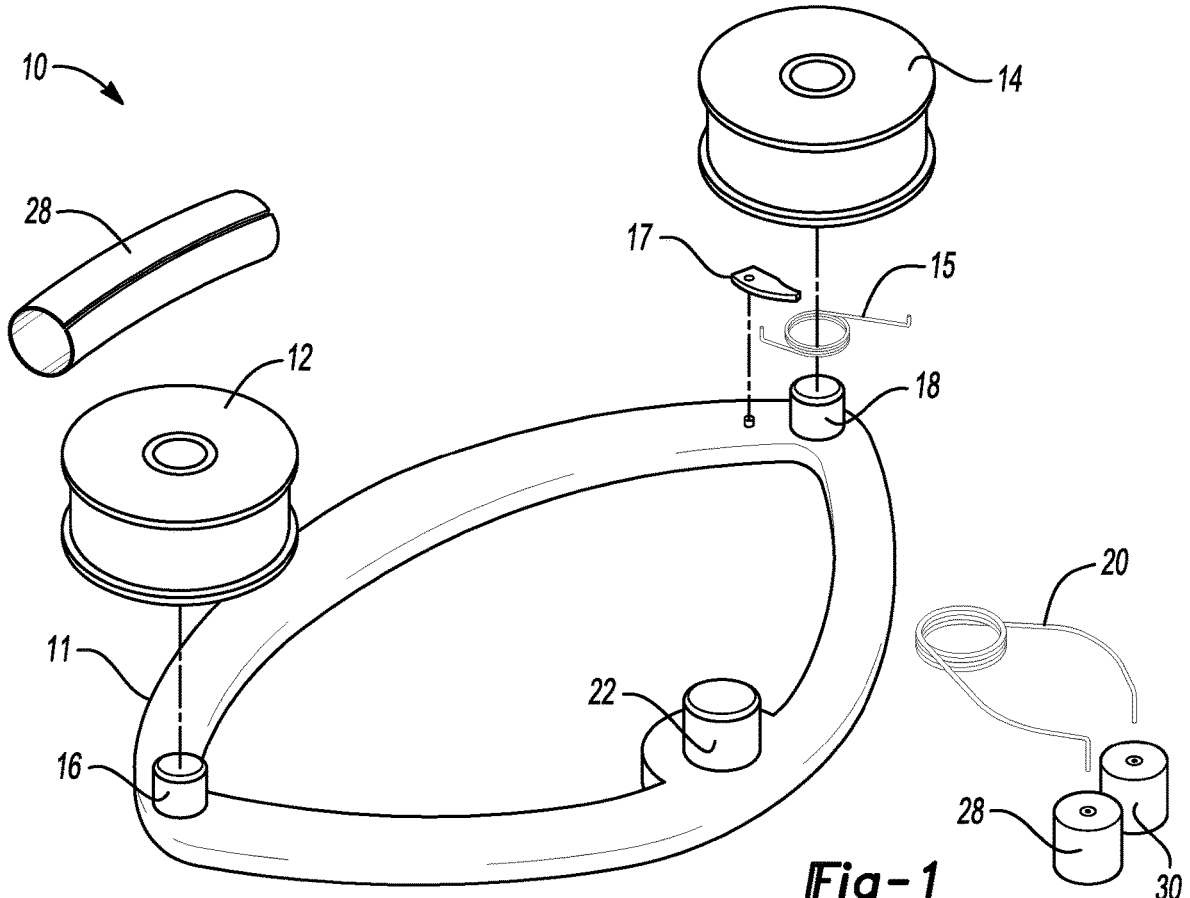
FIG. 1 is a perspective view of an applicator device according to the 1st embodiment of this disclosure.
Figure 2:
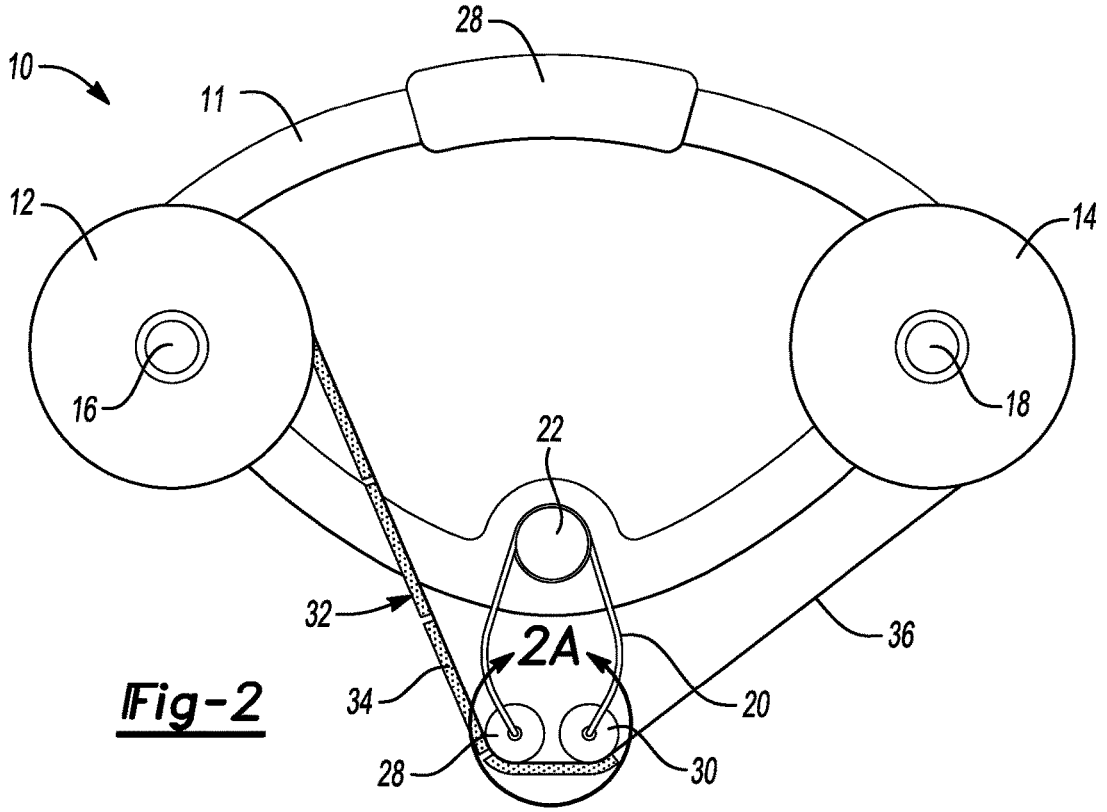
FIG. 2 is a top view of the applicator device according to a 1st embodiment of this disclosure.
Figure 2A:
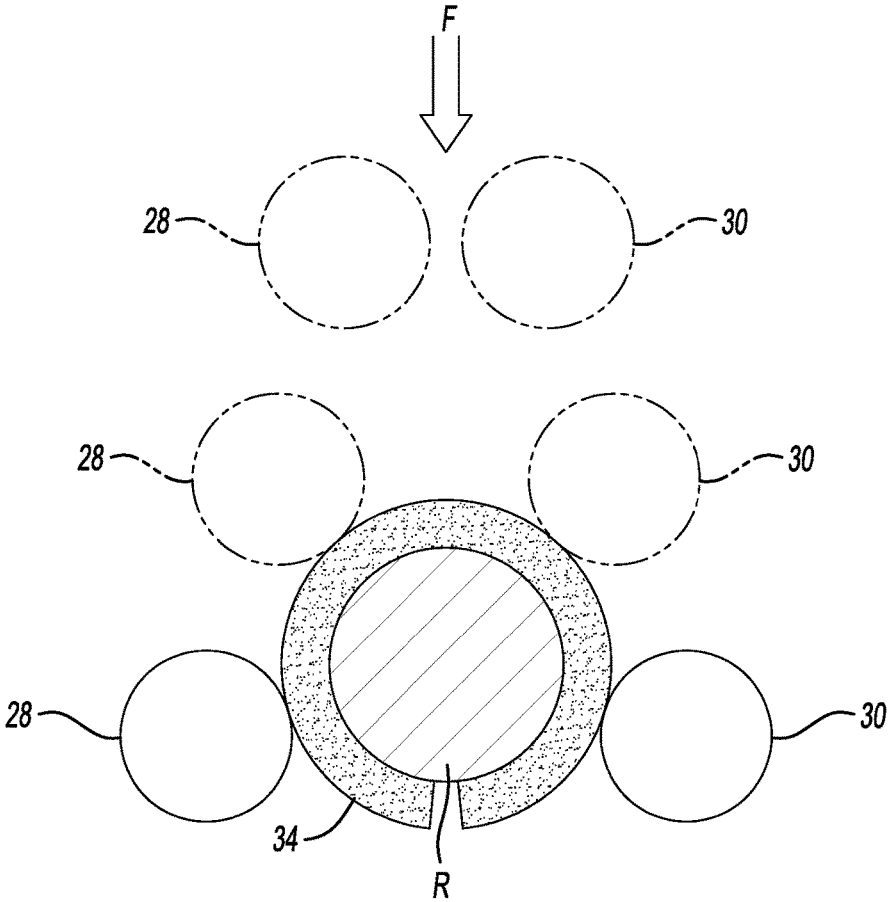

Referring to FIGS. 1 and 2, a perspective view and a top view of the applicator device 10 according to one embodiment of the disclosure is illustrated. The applicator device 10 includes two spools 12 and 14 and a body 11. Although the body 11 shown in FIGS. 1 and 2 has a triangular shape, the body may have other shapes, e.g. rectangular or circular. The body is preferably made of a lightweight material such as plastic or aluminum. The material needed to have a sufficient strength to allow a user to apply a force to a rod, while applying the tape or coating. The two spools are referred to as a tape carrier 12 and a backing carrier or retracting pulley 14.

The tape carrier 12 is pivotally connected to one of the corners of the body 11. A backing carrier 14 is pivotally attached to the corner opposite of the tape carrier 12. The tape carriers-12 and the backing carrier 14 are connected to the body 11 by shafts 16 and 18, respectively. The tape carrier 12 and backing carrier 14 are preferably made of a plastic material such as but not limited to nylon, delrin, or any other polymeric material. At least one spring 20 is mounted to a spring mount 22 which is disposed on the body 11 between the tape carrier 12 and the backing carrier 14. A handle 28 is disposed on a portion of the body 11 located opposite of the applicator rollers 28 and 30. The handle is configured to allow a user to grasp and operate the applicator device.

The spring 20 includes a first leg 24 and second leg 26 that outwardly extends from the body. Applicator rollers 28 and 30 are each attached to the first leg 24 and second leg 26, respectively. The first leg 24 and second leg 26 are biased towards each other by the resistance of the spring to form a claw shaped feature. A roll of tape or other coating 32 is wound on the tape carrier 12 and extends therefrom across the applicator rollers 28 and 30 to the backing carrier 14. The roll of tape or coating 32 includes perforated sections 34 attached to a backing strip 36. An adhesive substance is disposed on a surface of the perforated tape section 34 that is attached to the backing carrier. The outwardly facing portion of the perforated sections, located on the side opposite of the side in contact with the rollers 28 and 30, includes an adhesive substance that may be applied to a rounded surface that is to be taped.

Referring specifically to FIG. 1, a spring 15 and pawl 17 are attached to the backing carrier 14 and the body 11. As will be described in greater detail below, spring 15 and pawl 17 facilitate a ratcheting movement to retract the roll of tape or other coating 32.

Referring to FIG. 2-A, a detailed view of the applicator device in operation is illustrated. During operation, a force is applied along the directional arrow F towards the rod R or other rounded surface. The applicator rollers 28 and 30 are illustrated as adjacent to each other before the operation. As the applicator device 10 moves towards the round member R, the round member R comes between the applicator rollers 28 and 30. In response to the rod coming between the rollers the backing carrier 14 rotates in a clockwise direction to create slack in the roll of tape 32. To facilitate application of the perforated tape section 34, the claw formed by the legs of the spring 20 are biased around the rod R. After the perforated tape section 34 is applied to the rod, the device is removed in a direction opposite of the directional arrow F. Upon the removal of the applicator device from the round member R, a portion of the baking strip 36 where the perforated section of tape 34 was located is stretched across the applicator rollers 28 and 30. The backing carrier in conjunction with the spring and pawl is rotated in a counter-clockwise direction to retract the backing strip 36 and position the next perforated section of tape 34 across the rollers 28 and 30. Preferably, the backing carrier retracts or rotates twice the amount in the counter-clockwise direction as compared to the clockwise direction. The rollers follow the outer peripheral portion or circumference of the rod R as the tape is applied to a majority of the surface of the rod R.

Figure 3:
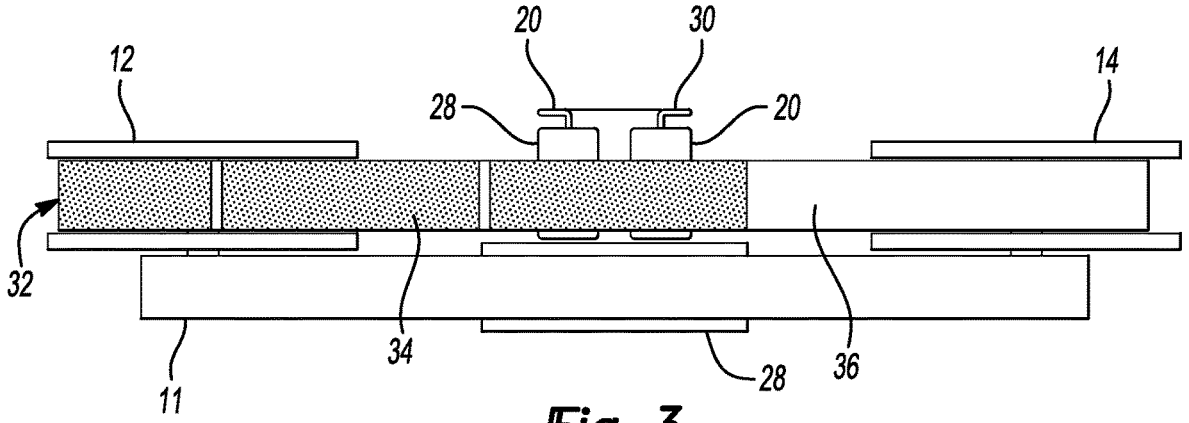
FIG. 3 is a plan view of the applicator device according to the 1st embodiment of this disclosure.

Referring to FIG. 3, plan view of the tape applicator device is illustrated. The tape carrier 12 and the backing carrier 14 are attached to the top surface of the body 11. However, in other embodiments, the tape carrier 12 and the backing carrier 14 may be pivotally mounted on the underside of the body 11.

Figure 4:
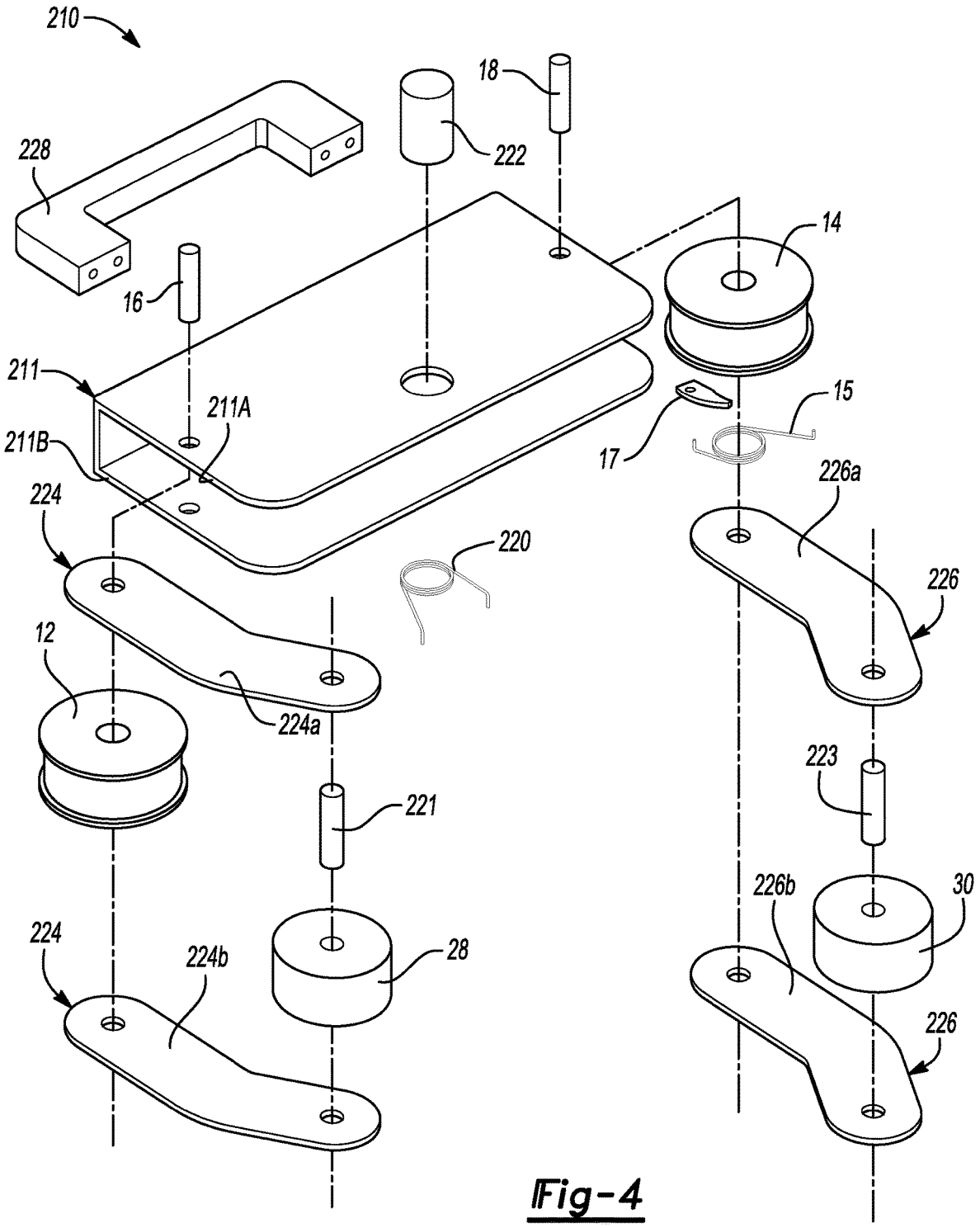
FIG. 4 is a perspective view of an applicator device according to a 2nd embodiment of this disclosure.
Figure 5:
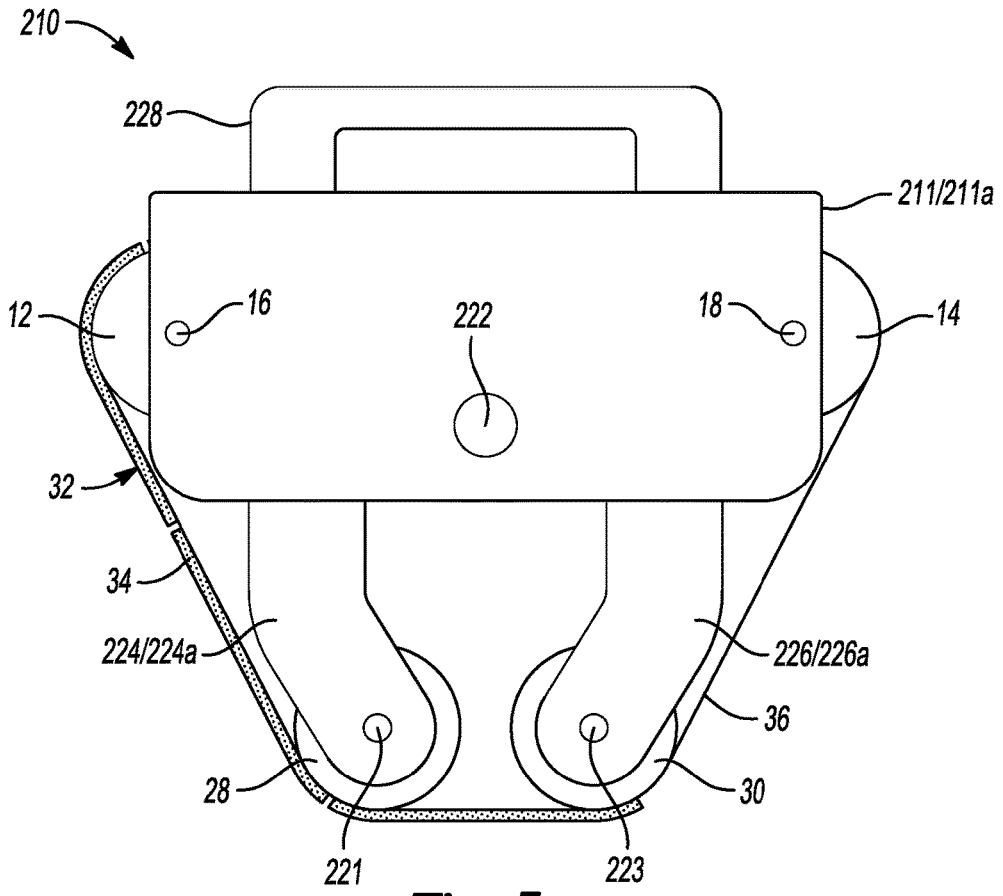
FIG. 5 is a top view of the applicator device according to the 2nd embodiment of this disclosure.

Referring to FIGS. 4 and 5, an applicator device 210 according to a second embodiment according to this disclosure is illustrated. The applicator device 210 includes a rectangular U-shaped body to 211. A tape carrier 12 and backing carrier to 14 which may be referred to as spools are disposed between a top member 211A and a bottom member 211B. The tape carrier 12 and backing carrier 14 are pivotally attached to the body 211 by shafts 16 and 18. Applicator arms 224 and 226 are pivotally connected to the body to 211, by shafts 16 and 18. A spring 220 is disposed on the spring mount 222 and bias the applicator arms 224 and 226 together. The applicator arms 224 and 226 may be attached to the body at another point or points.

A handle 228 is disposed on the body located opposite the applicator arms 224 and 226. The handle is configured to allow user to grasp the applicant device. The applicator arms each include applicator roller 28 and 30, respectively. The roll of tape is wound on the tape carrier 12 and stretches across the applicator rollers 228 to 230 to the backing carrier to 14. The roll of tape preferably includes perforated sections that have adhesive surface opposite of the applicator rollers 228 and 238 and are attached to the backing strip.

Figure 6:
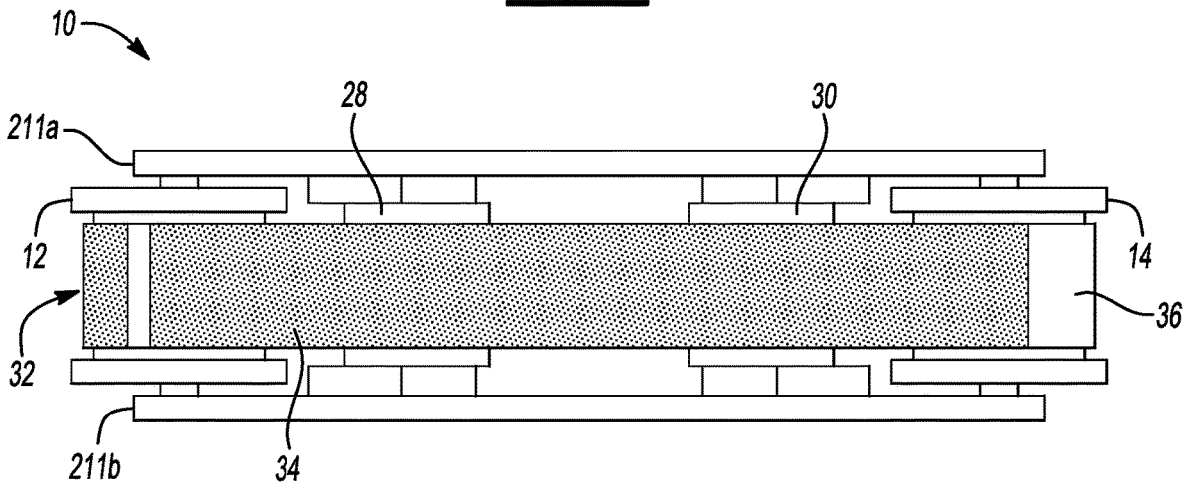
FIG. 6 is a plan view of the applicator device according to the 2nd embodiment of this disclosure.

Referring to FIG. 6, a plan view of the tape applicator device 210 according to a second embodiment of this disclosure is illustrated. The tape carrier to 211 backing carrier 214 are sandwiched between the top member 211*a* and the bottom member 211*b*.

Figure 7:
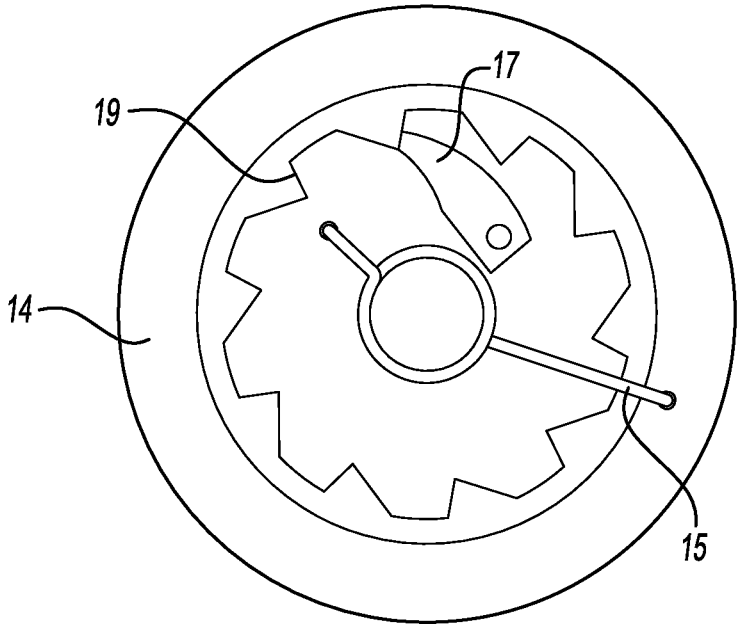
FIG. 7 is a bottom view of a retractor pulley according to one embodiment of this disclosure.

Referring to FIG. 7, the backing carrier according to the first or second embodiment of this disclosure, is illustrated. A pawl 17 and spring 15 are each cooperatively attached to the body 11/211 (FIGS. 1-2 and FIGS. 3-6). The pawl 17 engages an internal gear 19 formed within the backing carrier 14. As tension is applied to the roll of tape 32, the backing carrier is rotated with sufficient force to overcome the pawl 17 and gear 19. Tension is applied to the spring as the backing carrier is unwound. Once the applicator device is removed from the taped surface, the spring provides sufficient force to retract the backing carrier 14 and tape 32. When the backing carrier retracts, a new piece of perforated tape 34 is indexed and placed across the rollers 28 and 30.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An indexing tape dispenser comprising:

a body;

a supply spool and retracting spool disposed on the body;

a claw formed by first and second arms, each pivotally attached to the body between the spools and each having at least one roller, wherein as the dispenser moves towards a rounded surface of a shaft, the first and second arms open responsive to a force on the at least one roller disposed on the first and second arms resulting from the shaft coming between the at least one roller disposed on the first and second arms such that the at least one roller disposed on the first and second arms rotate to travel around the shaft to apply the tape; and a spring and a pawl, wherein the spring and pawl are operatively coupled between the retracting spool, wherein the retracting spool defines an internal gear portion, and wherein as the dispenser is removed from the rounded surface of the shaft, the spring, pawl and internal gear cooperate to facilitate a ratcheting mechanism and the first and second arms close towards one another.

2. The dispenser of claim 1, wherein the first and second arms each have a distal end and wherein the first and second arms each include a top member and bottom member, wherein the at least one roller disposed on the first arm are disposed within the top member and bottom member of the first arm and wherein the at least one roller disposed on the second arm are disposed within the top and bottom member of the second arm.

3. The dispenser of claim 1, further comprising at least one applicator-arm spring, wherein the applicator-arm spring applies a force to each of the arms to bias the arms towards each other.

4. The dispenser of claim 3, wherein during operation the at least one roller disposed on the first and second arms are pressed against the rounded surface to be taped, and the at least one roller disposed on the first and second arms and the at least one spring are biased around the rounded surface to apply pressure between a piece of tape and the rounded surface.

5. The dispenser of claim 1, wherein each of the rollers has an outer diameter and wherein the outer diameter corresponds to a diameter of the shaft such that a piece of tape covers a predetermined portion of the shaft.

6. A tape applicator device comprising:

a planar body;

a supply pulley and a retracting pulley each pivotally attached to the body;

a claw formed by first and second applicator arms each pivotally attached to a portion of the body that is disposed between the supply pulley and the retracting pulley; and at least two rollers, wherein one of the at least two rollers is pivotally attached to a distal end of one of the first applicator arm and one of the at least two rollers is pivotally attached to a distal end of the second applicator arm, wherein during operation, as the device moves towards a rounded surface, the at least two rollers move circumferentially about the rounded surface and the supply pulley is rotated to provide a perforated piece of tape, and wherein as the device is removed from the rounded surface, the retracting pulley retracts a roll of tape such that a new piece of perforated tape is positioned across the at least two rollers.

7. The device of claim 6, further comprising a spring and a pawl, wherein the spring and pawl are operatively coupled between the retracting pulley, wherein the retracting pulley defines an internal gear portion, and wherein the spring, pawl and internal gear portion cooperate to facilitate a ratcheting movement of the retracting pulley.

8. The device of claim 7, further comprising at least one applicator-arm spring, wherein the applicator-arm spring applies a force to each of the arms to bias the arms towards each other.

9. The device of claim 8, wherein each of the rollers has an outer diameter and wherein the outer diameter corresponds to a diameter of the rounded surface such that the piece of tape covers a predetermined portion of the rounded surface.

10. The device of claim 9, wherein the retracting pulley is in a locked position before the rounded surface comes between the rollers and wherein the spring provides sufficient force to rotate the retracting pulley after the piece of tape is applied and the rollers come together.

* * * * *